US006533433B1

(12) United States Patent
Stark et al.

(10) Patent No.: US 6,533,433 B1
(45) Date of Patent: Mar. 18, 2003

(54) ADJUSTABLE MIRROR ASSEMBLY

(76) Inventors: Phyllis E. Stark, 1390 Creekside Dr. #30, Walnut Creek, CA (US) 94596; Sherri Ann LeClair, 1390 Creekside Dr. #30, Walnut Creek, CA (US) 94596

( * ) Notice: Subject to any disclaimer, the term of this patent is extended or adjusted under 35 U.S.C. 154(b) by 0 days.

(21) Appl. No.: 09/967,279

(22) Filed: Oct. 1, 2001

(51) Int. Cl.[7] ..... F21V 33/00

(52) U.S. Cl. ..... 362/142; 362/135; 362/136; 362/140; 362/141; 362/144; 362/418; 362/427; 362/428; 362/295

(58) Field of Search ..... 362/142, 135, 362/136, 140, 141, 144, 418, 427, 428, 295

*Primary Examiner*—Sandra O'Shea
*Assistant Examiner*—Mark Tsidulko
(74) *Attorney, Agent, or Firm*—Donald R. Schoonover

(57) ABSTRACT

A mirror assembly includes a mirror that can be moved up and down by simply operating appropriate buttons and includes a light that can be dimmed as desired by operating a dimmer switch on a base unit. A storage drawer is also included and the angle of the mirror with respect to a user can also be easily adjusted.

7 Claims, 1 Drawing Sheet

ADJUSTABLE MIRROR ASSEMBLY

BACKGROUND OF THE INVENTION

1. Field of the Invention

The present invention relates to the general art of mirrors, and to the particular field of adjustable supports for mirrors.

2. Discussion of the Related Art

People use mirrors for a multitude of tasks. For example, people shave, apply make-up, comb their hair, check their appearance, and the like by using a mirror. Accordingly, there are a multitude of mirror designs available.

Some tasks are most efficiently performed when the user is most comfortable with respect to the mirror. However, this is not always possible, especially if the user is tall with respect to the mirror placement. If the mirror is in the wrong position with respect to the user, the user's posture may be improper. People have been known to prop a mirror up on books or the like in order to place the mirror at a desired height. This is not efficient and the mirror may even fall over.

Therefore, there is a need for a mirror that can be adjusted to assume a height with respect to the user that is most comfortable for that user. Still further, there is a need for a mirror that can be adjusted so a user assumes the proper posture when using the mirror.

While some known mirrors are adjustable, these known adjustable mirrors are often cumbersome to adjust, requiring cranks, and the like. This is not only inconvenient, but diverts a user's concentration away from his or her primary task.

Therefore, there is a need for a mirror that can be efficiently adjusted to assume a height with respect to the user that is most comfortable for that user.

Still further, even once a mirror is positioned at a desired height with respect to a user, the user needs the clearest possible view of himself or herself. Such a clear view requires at least two elements. First, the mirror should be oriented with respect to the user in the most advantageously possible manner. A relatively perpendicular orientation between the mirror and the user is not always the most advantageous orientation. For example, a user may want to see how he or she looks at an angle such as in a partial profile. This may require the user to move a mirror in its entirety. Again, this may not be the most efficient way to achieve this goal.

Therefore, there is a need for a mirror which can be efficiently oriented into the most advantageous orientation with respect to a user.

Second, the user may want to see his or her reflection in non-ambient light. That is, for example, the user may be applying make-up for use in bright sunlight but by doing so inside a darkened room. In such a case, daylight-type lighting is required. While some known mirrors have lights associated therewith, these lights generally cannot be efficiently adjusted, if they can be adjusted at all.

Therefore, there is a need for a mirror which can be efficiently adjusted to provide a desired lighting situation.

While some known mirrors are angularly adjustable, and some known mirrors have lights associated with them, the inventor is not aware of any mirrors that permit a user to coordinate between a selected mirror orientation with respect to a user and light associated with the mirror. Accordingly, such known mirrors are not as efficient as possible because, for example, even though the light may be constant, a person's face may look slightly different in the same light when the viewing angle changes.

Therefore, there is a need for a mirror in which a user can efficiently change both angular orientation with respect to the user and lighting of the mirror.

Still further, people often have many implements that are used when they use a mirror. For example, combs, brushes, make-up, and the like are often used in front of a mirror. Such implements are often stored in a drawer and must be retrieved for use. Sometimes, the drawer is not convenient with respect to the mirror position and the implement must be retrieved and carried to the mirror. As is often the case, once in front of the mirror, the user discovers that they have not brought all of the necessary implements with them, and thus must move to return to the storage drawer and then return to the mirror. This is frustrating if not time consuming.

Therefore, there is a need for a mirror which can efficiently store items that are commonly used in conjunction with the mirror.

PRINCIPAL OBJECTS OF THE INVENTION

It is a main object of the present invention to provide a mirror that has multiple degrees of adjustment available.

It is another object of the present invention to provide a mirror that can be adjusted to assume a height with respect to the user that is most comfortable for that user.

It is another object of the present invention to provide a mirror that can be efficiently adjusted to assume a height with respect to the user that is most comfortable for that user.

It is another object of the present invention to provide a mirror that can be efficiently oriented into the most advantageous orientation with respect to a user.

It is another object of the present invention to provide a mirror that can be efficiently adjusted to provide a desired lighting situation.

It is another object of the present invention to provide a mirror that can efficiently change both angular orientation with respect to a user and lighting of the mirror.

It is another object of the present invention to provide a mirror that can be adjusted so a user assumes the proper posture.

It is another -object of the present invention to provide a mirror that can efficiently store items that are commonly used in conjunction with the mirror.

SUMMARY OF THE INVENTION

These, and other, objects are achieved by a mirror assembly that includes a base unit which serves as a support for the mirror as well as a storage unit, and a mirror that can be easily adjusted for height mounted on the base unit. A light completely surrounds the mirror and is controlled by an on/off switch as well as a dimmer switch located on the base unit. A motor unit is mechanically connected to the mirror to move the mirror up or down by operating buttons on the base unit.

In this manner, a user can easily adjust the height of the mirror as well as the angle of the mirror and the light associated with the mirror. The user can also easily store all implements necessary in close proximity to the mirror.

DETAILED DESCRIPTION OF THE INVENTION

Figure 1:
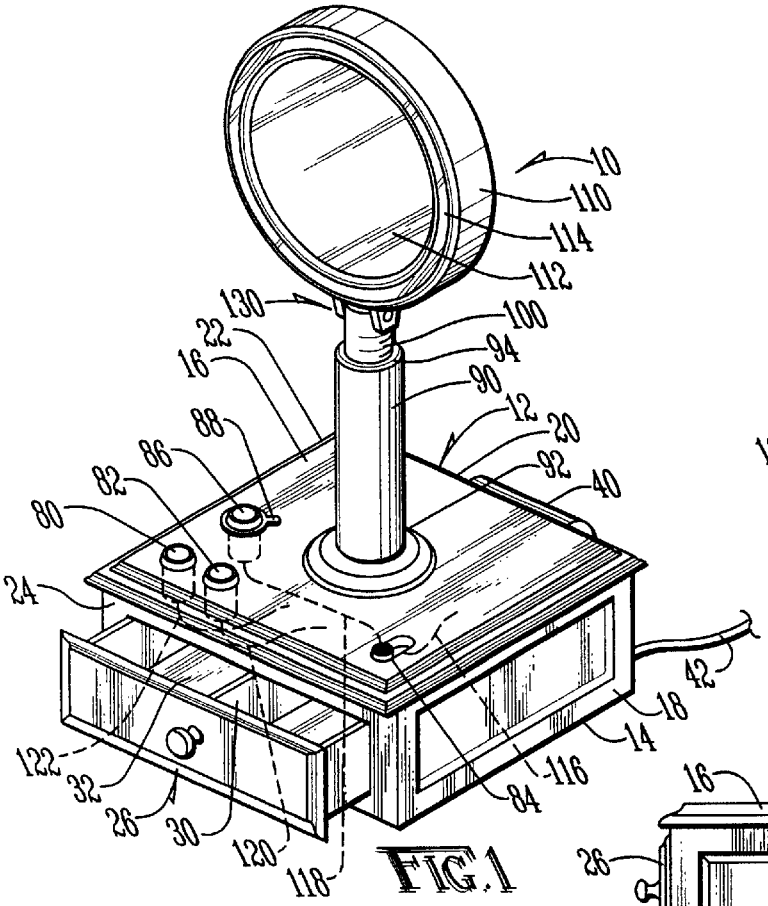
FIG. 1 is a top, front and side perspective view showing the mirror assembly embodying the present invention.

Other objects, features and advantages of the invention will become apparent from a consideration of the following detailed description and the accompanying drawings.

The mirror assembly of the present invention can easily be adjusted both spatially and the light associated therewith so a user can easily select the most advantageous orientation of the mirror with respect to himself or herself and select the amount of light provided for the most advantageous viewing. The mirror assembly of the present invention also has storage for storing items a user may want to be located next to a mirror.

Referring to the figures, it is seen that the mirror assembly 10 of the present invention comprises a base unit 12, which includes a bottom 14, a top 16, and four sides 18, 20, 22 and 24. A storage drawer 26 is slidably mounted on base unit 12 on side 24 of the four sides. Storage drawer 26 includes a plurality of divider walls, such as divider wall 30 dividing storage drawer 26 into a plurality of compartments, such as compartment 32. A user can store combs, brushes, scissors, makeup or the like in the compartments of storage drawer 26 so these items are convenient for use when mirror assembly 10 is being used.

Mirror assembly 10 further includes an electric motor unit 40 mounted on base unit 12 and which is connected to a power source (not shown) such as utility power via a house outlet, by an electric cord 42. Motor unit 40 is a known type of motor unit which has a rotor that rotates when the motor is activated and an output shaft that rotates with the rotor and which is located inside base unit 12. The output shaft is not shown in FIG. 1 but extends inside the base unit and rotates when motor unit 40 is activated.

Mirror assembly 10 further includes a motor control unit. 50 (best shown in FIG. 5) located in base unit 12 and which is connected to motor output shaft 52 of motor unit 40 and has a first configuration to cause rotation associated with motor output shaft 52 of motor unit 40 to be in a first direction when motor unit 40 is activated and a second configuration to cause rotation associated with motor output shaft 52 of motor unit 40 to be in a second direction when the motor unit is activated.

Figure 5:
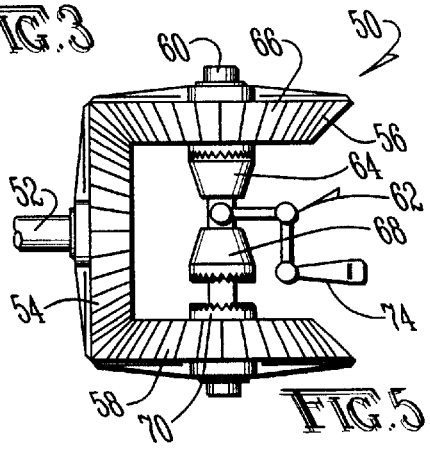
FIG. 5 shows a mechanical connection for translating motor output shaft rotation into a selected one of two directions, according to the present invention.

The preferred form of motor control unit 50 is shown in FIG. 5 to include a shaft output gear 54 fixed to motor output shaft 52 for rotation therewith when the motor unit is activated, a first output gear 56 meshed with shaft gear 54 for rotation therewith and a second output gear 58 also meshed with output gear 56 for rotation therewith. A motor control unit output shaft 60 is connected to a movable connecting unit 62 which includes a first gear 64 that is engageable with a gear 66 fixed to gear 56 for rotation therewith when movable connecting unit 62 is in a first configuration as shown in FIG. 5, and a second gear 68 that is engageable with a gear 70 fixed to gear 58 for rotation therewith when movable connecting unit 62 is in a second configuration. A connection unit 74 moves movable connecting unit 62 between the first and second configurations. Connection unit 74 can be a mechanical connection, such as a lever as shown in FIG. 5 and which will extend out of base unit 12 to be operated by a user, or by an electrical drive that includes a solenoid driven from the power source and operated by a button located on the base unit. When a button is used, a simple circuit is included that moves a solenoid rod one way when the power source is connected to the solenoid in one direction and moves the solenoid rod in another direction when the power source is connected to the solenoid in another direction. The solenoid can also be operated to have a spring bias that positions the solenoid rod in a manner that places unit 62 in the first configuration when power is applied to the solenoid, and allows the spring to move the solenoid rod to place unit 62 in the second configuration when power is not applied, with the button on the base unit being used to apply power to the solenoid. As can be understood from FIG. 5, using gear 56 rotates motor control unit output shaft 60 in one direction, while using gear 58 rotates motor control unit output shaft 60 in the opposite direction even though gear 54 rotates in only one direction.

As can be seen in FIG. 1, mirror assembly 10 further includes a plurality of control buttons on the top of said base unit. The buttons are used to control operation of mirror assembly 10 and include a mirror height control up button 80 electrically connected to motor control unit 50 to place motor control unit 50 in the first configuration when mirror height control up button 80 is activated, a mirror height control down button 82 electrically connected to motor control unit 50 to place motor control unit 50 in the second configuration when mirror height control down button 82 is activated, a motor unit on/off switch 84 electrically connected to motor unit 40 to connect motor unit 40 to a power source when motor unit on/off switch 84 is in an ON configuration and to disconnect motor unit 40 from the power source when motor unit on/off switch 84 is in an OFF configuration, a light unit on/off switch 86 which will be discussed in greater detail below, and a light unit dimmer switch 88 which will also be discussed in greater detail below and which will include a rheostat such as is usually associated with dimmer switches. Buttons 80–88 are suitably connected to the elements controlled thereby by suitable electrical circuits that are well known to those skilled in the electrical art and thus will not be discussed herein.

Figure 4:
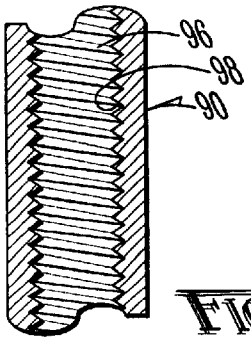
FIG. 4 shows a pedestal having a bore extending longitudinally therethrough and having a screw thread defined on the pedestal adjacent to the bore.

Mirror assembly 10 further includes a pedestal 90 mounted on top 16 of base unit 12 and extends away from base unit 12 so the pedestal 90 extends upward when the base unit 12 is oriented as shown in FIG. 1. Pedestal 90 has a bottom end 92 fixed to top 16 of base unit 12 and a top end 94 spaced away from base unit 12. As indicated in FIG. 4, pedestal 90 has a bore 96 extending longitudinally therethrough from bottom end 92 of pedestal 90 to top end 94 of pedestal 90. An internal screw thread 98 is defined in the internal surface of pedestal 90 adjacent to bore 96 for a purpose that will be understood from the present disclosure.

Figure 3:
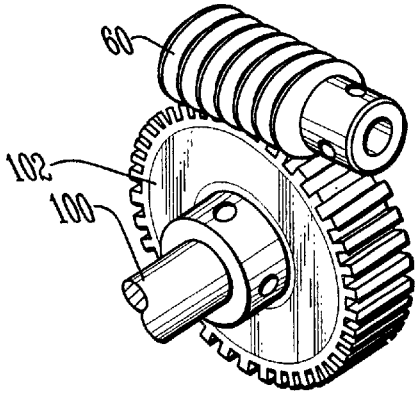
FIG. 3 is a perspective view of a worm mesh mechanical connection for connecting a motor unit to a screw which extends through a pedestal and on which a mirror frame is mounted.

Mirror assembly 10 further includes a mechanical connecting unit in the pedestal 90 which is mechanically connected to output shaft 60 of motor unit, 40 to move in one direction when output shaft 60 of motor unit 40 rotates in the first direction and to move in another direction when output shaft 60 of motor unit 40 rotates in the second direction. The preferred form of this mechanical connecting unit includes an externally threaded screw 100 that extends through bore 96 and is threadably connected to internal thread 98 on pedestal 90. As shown in FIG. 3, screw 60 is meshed with a gear 102 in a worm mesh configuration, with gear 102 being connected to output shaft 60 to rotate therewith. When shaft 60 rotates in the first direction, screw 100 rotates in one direction that corresponds to the rotation direction of gear 102, and will move up or down in pedestal 90 due to the threadable engagement between screw 100 and internal thread 98 on the pedestal. However, when shaft 60 rotates in the second direction, screw 100 rotates in another direction that corresponds to the rotation direction of gear 102, and will move down or up in pedestal 90 due to the threadable engagement between screw 100 and internal thread 98 on the pedestal. Since motor control unit 50 and gears 100 and 102 require room in base unit 12, drawer 26 is shaped and/or sized to accommodate these elements. Furthermore, the bottom 14 of base unit 12 may have a cutout to allow screw 100 to extend into the bottom if necessary. It is noted that only a portion of screw 100 is shown in FIG. 3. It is further noted that gear 102 can be located inside pedestal 90 so a wider range of movement for the mirror assembly can be obtained if desired. Further gears can be used to route the rotation of shaft 60 from unit 50 to gear 102 as necessary so the units can all be accommodated in mirror assembly 10.

Mirror assembly 10 further includes a mirror mounting frame 110 movably mounted on pedestal 90 near top end 94 of pedestal 90 and which is connected to screw 100 of the mechanical connecting unit to move therewith to move away from base unit 12 when screw 100 of the mechanical connecting unit moves in the one direction associated with the mechanical connecting unit and to move toward base unit 12 when screw 100 of the mechanical connecting unit moves in the another direction of the mechanical connecting unit.

A mirror 112 is mounted on mirror mounting frame 110 and moves therewith. This permits a user to easily adjust the height of mirror 112 by simply operating height control buttons 80 and 82. The mirror can be reflective on both faces thereof, with one face magnifying the reflection and the other face providing an accurate image. It is also noted that while the mirror is shown as being circular in outer shape, other shapes, including oval, rectangular, or the like, can also be used without departing from the scope of the present disclosure.

A light 114 is located on mirror mount 110 and completely surrounds mirror 112 so proper light is associated with the mirror. Light 114 can be located on both sides of the mirror mount so both reflecting surfaces will be lighted. Light 114 can be any suitable form, such as florescent, daylight, or the like.

Electrical connections indicated by electrical connection 116 and circuit 118 electrically connect light 114 to the power source via light unit on/off switch 86 and via light unit dimmer switch 88 to activate light 114 when light unit on/off switch 86 is in an ON configuration and to deactivate the light 114 when light unit on/off switch 86 is in an OFF configuration, with light unit dimmer switch 88 connecting light 114 to the power source via light unit on/off switch 86 so output of light 114 can be controlled via light unit dimmer switch 88 when light unit on/off switch 86 is in the ON configuration. As shown, dimmer switch 88 surrounds on/off switch 86, but this dimmer switch could be separate if desired. Electrical connections such as connections 116, 120 and 122 connect the remaining control buttons to the appropriate circuits to operate the motor unit and its associated units in the manner discussed above. Such buttons are connected to the associated elements via the on/off switch 84 in a manner known to those skilled in the art of circuit design.

Figure 2:
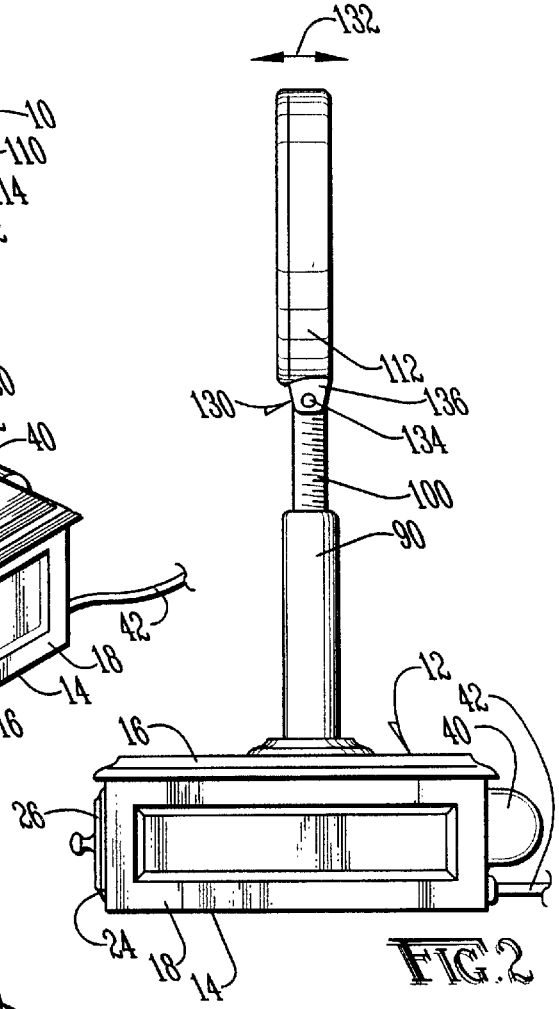
FIG. 2 is a side elevational view of the mirror assembly.

In order to add further adjustment features to the mirror assembly, mirror mounting frame 110 is pivotally connected to screw 100 by a pivot connecting unit 130 that permits the mirror to move in a direction indicated by double-headed arrow 132 in FIG. 2. This adds another degree of movement to the above-discussed up and down height adjustment movement. Pivot connection unit includes a pivot pin 134 connecting a yoke 136 to the end of screw 100 to move therewith. Yoke 136 is fixed to mirror mounting frame 112 and pivot pin 134 can include a set screw type connection whereby the mirror mounting frame can be set in a selected orientation once such orientation is selected by simply tightening down the set screw type pivot pin 134. Pivot pin 134 can include a wing nut type design so operation thereof is easy.

It is understood that while certain forms of the present invention have been illustrated and described herein, it is not to be limited to the specific forms or arrangements of parts described and shown.

We claim:

1. A mirror assembly comprising:

a) a base unit which includes (1) a bottom, a top, and four sides, (2) a storage drawer slidably mounted on said base unit on one side of said four sides, said storage drawer including a plurality of divider walls dividing said storage drawer into a plurality of compartments, (3) an electric motor unit mounted on said base unit and having an output shaft located inside said base unit, the output shaft of said motor unit rotating when said motor unit is activated, (4) motor control unit located in said base unit and connected to said motor unit and to the output shaft of said motor unit and having a first configuration to cause rotation of the output shaft of said motor unit to be in a first direction when said motor unit is activated and a second configuration to cause rotation associated with the output shaft of said motor unit to be in a second direction when said motor unit is activated, (5) a plurality of control buttons on the top of said base unit which include (A) a mirror height control up button electrically connected to said motor control unit to place said motor control unit in the first configuration when the mirror height control up button is activated, (B) a mirror height control down button electrically connected to said motor control unit to place said motor control unit in the second configuration when the mirror height control down button is activated, (C) a motor unit on/off switch electrically connected to said motor unit to connect said motor unit to a power source when said motor unit on/off switch is in an ON configuration and to disconnect said motor unit from the power source when said motor unit on/off switch is in an OFF configuration, (D) a light unit on/off switch, and (E) a light unit dimmer switch;

b) a pedestal mounted on the top of said base unit and extending away from said base unit, said pedestal having a bottom end fixed to the top of said base unit and a top end spaced away from said base unit and a bore extending longitudinally through said pedestal from the bottom end of said pedestal to the top end of said pedestal;

c) a mechanical connecting unit in said pedestal and mechanically connected to the output shaft of said motor unit to move in one direction when the output shaft of said motor unit rotates in the first direction and to move in another direction when the output shaft of said motor unit rotates in the second direction;

d) a mirror mounting frame movably mounted on said pedestal near the top end of said pedestal and connected to said mechanical connecting unit to move therewith to move away from said base unit when said mechanical connecting unit moves in said one direction of said mechanical connecting unit and to move toward said base unit when said mechanical connecting unit moves in the another direction of said mechanical connecting unit;

e) a mirror mounted on said mirror mounting frame;

f) a light on said mirror mount and surrounding said mirror; and g) electrical connections electrically connecting said light to the power source via said light unit on/off switch and via said light unit dimmer switch to activate said light when said light unit on/off switch is in an ON configuration and to deactivate said light when said light unit on/off switch is in an OFF configuration, said light unit dimmer switch connecting said light to the power source via said light unit on/off switch so output of said light can be controlled via said light unit dimmer switch when said light unit on/off switch is in the ON configuration.

2. The mirror assembly defined in claim 1 wherein said mechanical connecting unit includes an externally threaded screw element extending through the bore extending longitudinally through said pedestal.

3. The mirror assembly defined in claim 2 further including a pivot connection unit connecting said mirror mounting frame to said externally threaded screw element.

4. The mirror assembly defined in claim 3 wherein said pivot connection unit includes a yoke connected to said mirror mounting frame and a pivot element connecting the yoke of said pivot connection unit to said externally threaded screw element.

5. The mirror assembly defined in claim 4 wherein the pivot element of said pivot connection unit includes a threaded connection between the pivot element of said pivot connection unit and the yoke of said pivot connection unit.

6. The mirror assembly defined in claim 5 wherein said light completely surrounds said mirror.

7. The mirror assembly defined in claim 6 further including an internal screw thread defined on said pedestal adjacent to the bore defined to extend longitudinally through said pedestal, said externally threaded screw element of said mechanical connecting unit threadably engaging the internal screw thread defined on said pedestal and connected to the output shaft of said motor unit via said mechanical connecting unit to move toward and away from the top of said base unit when the output shaft of said motor unit is driven in the first direction of the output shaft and the second direction of the output shaft.

* * * * *